United States Patent [19]

Correnti et al.

[11] Patent Number: 4,629,229

[45] Date of Patent: Dec. 16, 1986

[54] DOOR LOCK DEVICE

[76] Inventors: Frank Correnti, 1740 S.W. 10th St., Boca Raton, Fla. 33432; Thomas Dell 'Acqua, 2652 N.E. 3rd St., Pompano Beach, Fla. 33062

[21] Appl. No.: 764,719

[22] Filed: Aug. 12, 1985

[51] Int. Cl.[4] ..... E05C 21/02

[52] U.S. Cl. ..... 292/246; 292/DIG. 2

[58] Field of Search ..... 292/288, 262, 264, 246, 292/347, DIG. 2

[56] References Cited

U.S. PATENT DOCUMENTS

| | | | |
|---|---|---|---|
| 878,607 | 2/1908 | Cairns | 292/264 |
| 2,726,112 | 12/1955 | Conhagen | 292/264 |
| 3,451,708 | 6/1969 | Brooks | 292/264 |
| 3,640,558 | 2/1972 | Gewertz et al. | 292/264 |
| 3,809,418 | 5/1974 | Canfield | 292/264 |
| 3,836,187 | 9/1974 | Buettner | 292/262 |
| 4,022,503 | 5/1977 | Bey | 292/264 |
| 4,155,577 | 5/1979 | Raymond | 292/264 |
| 4,483,558 | 11/1984 | Van Meter | 292/339 |

*Primary Examiner*—Richard E. Moore

*Attorney, Agent, or Firm*—Oltman and Flynn

[57] ABSTRACT

A lock device for use on the doorknob of a vertically hinged door. The lock device includes a flexible cable with opposite legs connected at one end to form a loop for insertion over the doorknob and a sleeve on the loop of the cable which extends around the reduced neck of the doorknob behind the head of the doorknob. The opposite end of the cable is retained in a box in the building wall next to the door jamb.

6 Claims, 11 Drawing Figures

DOOR LOCK DEVICE

SUMMARY OF THE INVENTION

This invention relates to a lock device which can be applied to a doorknob from the inside of the door to prevent it from being opened from the outside.

Many doors leading into a dwelling area in a building or into a bedroom in such a dwelling area have locks which can be disabled, especially spring locks. The present invention is directed to an auxiliary lock for such a door which can be stored in an unobstrusive position when not in use and which can be applied to the doorknob on the inside of the door when a person inside the dwelling area or a room in the dwelling area wishes to enhance his or her security, such as when retiring at the end of the day.

In accordance with this invention, the auxiliary lock device comprises a flexible cable forming a loop on which a sleeve is positioned for engagement behind the head of the usual inside doorknob to prevent the door from being opened from the outside even after the main door lock has been disabled. The loop of the cable can be extended to slip over the doorknob and then it can be shortened to hold the door closed tightly.

A principal object of this invention is to provide a novel auxiliary door lock for engagement with the doorknob on the inside of the door to prevent it from being opened from the outside.

Further objects and advantages of this invention will be apparent from the following detailed description of three presently preferred embodiments, shown in the accompanying drawings.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

FIGS. 1–6

Figure 1:
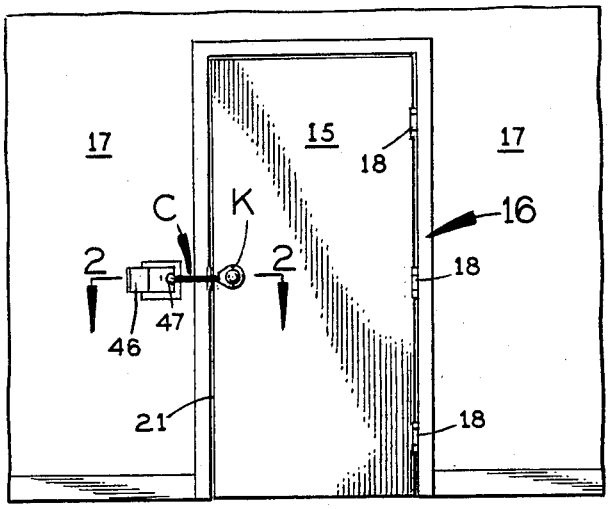
FIG. 1 is an elevational view showing a first embodiment of the present lock device on an inward-opening door in a wooden doorway frame.
Figure 2:
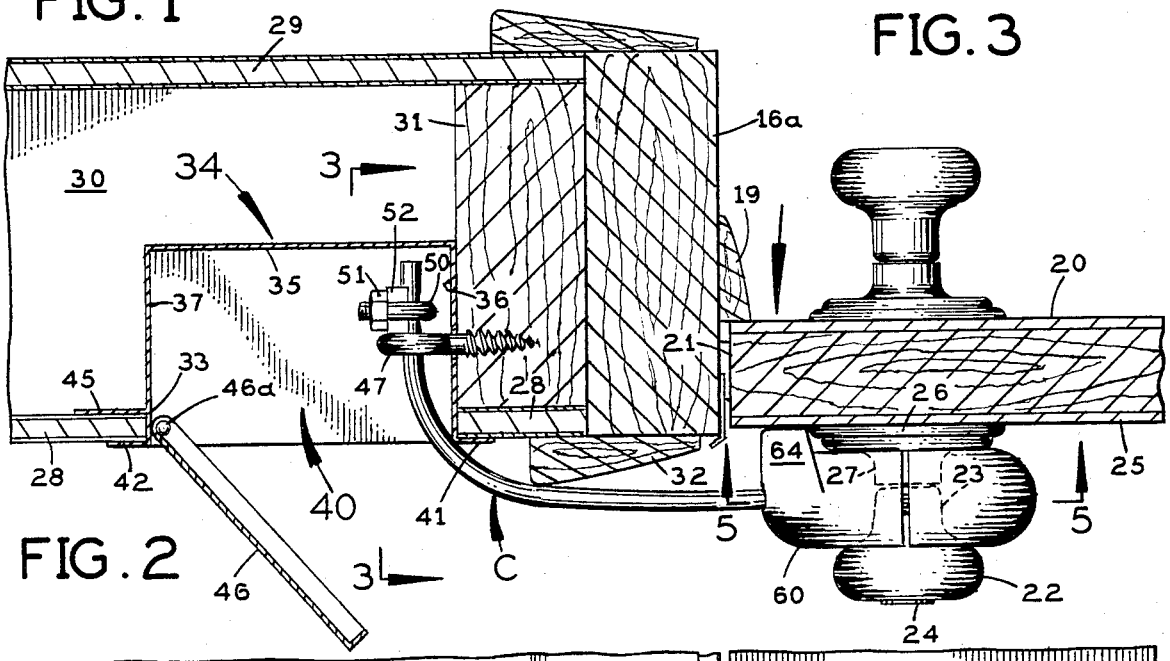
FIG. 2 is a horizontal cross-section on a larger scale taken along the line 2—2 in FIG. 1 and showing this lock device in locking position on the doorknob.

FIG. 1 shows a conventional wood door 15 in a conventional wood frame 16 located in a wall 17 of a building. As shown, the door 15 is mounted on vertical hinges 18 at its right side which enable it to be pivoted from the closed position shown in FIG. 1 to an open position in which it extends inside this room of the building. As shown in FIG. 2, the door jamb **16*a* of the door frame 16 at its left side carries a door stop 19 which is engaged by the outside face 20 of the door next to the left vertical edge 21 of the door when the door is in the closed position shown in FIG. 1. The door 20** may be of any suitable solid or laminated construction.

Close to its left edge 21 the door has a doorknob K of conventional design with a rounded head 22 (FIG. 2) on its outer end and a smaller diameter neck 23 extending from the head toward the door. The door knob may be turned in the usual way to operate a lock (not shown) in this side of the door which cooperates with a keeper in the door jamb **16*a*. Typically, this lock is a spring lock with a push button release 24 in the doorknob. The lock is located in a recess in the door which is covered on the inside face 25 of the door by a cover plate 26 having a smaller diameter neck 27 which projects toward the door knob neck 23** and preferably is the same cross-sectional size as the doorknob neck. This cover plate is attached to the door by screws.

The wall 17 in which the doorway frame 16 is mounted is shown in FIG. 2 as a hollow wall having a flat, relatively thin, wallboard panel 28 on the inside, a similar wallboard panel 29 on the outside, and a space 30 several inches deep between the inside and outside panels. A vertical wood stud 31 is nailed to the door jamb **16*a* on the opposite side from the doorway opening. This stud is located between the inside and outside panels 28 and 29 of the wall 17 and is nailed to both of them so that it provides a rigid support for both wall panels and for the door jamb 16*a*. A wooden facing strip 32 is nailed to the door jamb 16*a* and the inside wall panel 28**.

On the opposite side of the stud 31 from the door jamb **16*a* the inner wall panel 28 is formed with a rectangular opening 33 at the same level as the doorknob. A rectangular sheet metal box 34 is mounted in this opening in the inside wall panel 28 and is located in the hollow wall space between the inside and outside wall panels 28 and 29 next to the stud 31**.

The box 34 has a flat vertical back wall 35 located about mid-way between the inside and outside wall panels, a vertical right side wall 36 next to the wall stud 31, a similar left side wall 37 away from the stud, a horizontal top wall 38 at the top of the opening 33 in the inside panel 28 of the building wall 17, and a horizontal bottom wall 39 at the bottom of this opening. The box 34 presents a rectangular opening 40 at the front which is bounded by laterally outwardly projecting lips 41 and 42 (FIG. 2) on its opposite sides and similar lips 43 and 44 (FIG. 3) at the top and bottom. These lips abut against the front face of the inside panel 28 of the building wall 17, i.e., the face of this panel at the inside of the room. The box has a laterally outwardly projecting lip 45 (FIG. 2) extending from its side wall 37 parallel to the front lip 42 and spaced from that front lip by substantially the thickness of the inside panel 28 of the building wall, so that this panel is snugly engaged between these lips.

A cover plate 46 is pivotally mounted at 46*a* at the front left corner of box 34 in FIG. 2. This cover plate is manually adjustable between an open position, as shown in the drawing, and a closed position covering the front of the box and extending flush with the inside panel 28 of building wall 17.

An eye 47 is screw-threaded into the door jamb 31 through an opening in the adjacent side wall 36 of box 34 about half-way between the top and bottom walls 38 and 39 of the box. Inside the box the eye 47 presents a generally circular loop which forms an opening, the axis of which extends horizontally parallel to the side walls of the box.

A flexible strong cable C of steel or the like, preferably covered by a plastic sheath, has upper and lower legs 48 and 49 (FIGS. 3 and 4) extending contiguous to one another and passing snugly but slidably through the opening in the eye 47. On the opposite side of the eye 47 from the front opening 40 of box 34, the upper and lower legs 48 and 49 of the cable are engaged by a clamp having a U-shaped bolt 50 extending three-quarters of the way around the cable and having screw-threaded opposite ends, nuts 51 threaded onto the ends of the U-bolt, and a notched cable retainer 52 engaged between these nuts and the upper and lower legs 48 and 49 of the cable to clamp them together. The cable clamp prevents the cable from being pulled completely through the eye 47, as shown in FIG. 2.

At the opposite end (FIG. 4) the cable presents a bight segment connecting its opposite, upper and lower legs 48 and 49 and forming a loop L which is adapted to extend around the doorknob.

Figure 5:
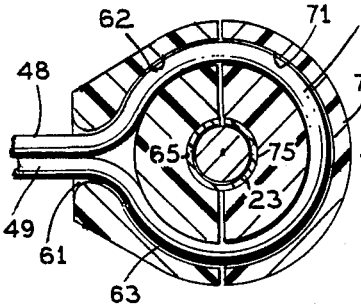
FIG. 5 is a vertical section taken along the line 5—5 in FIG. 2 at the doorknob.
Figure 6:
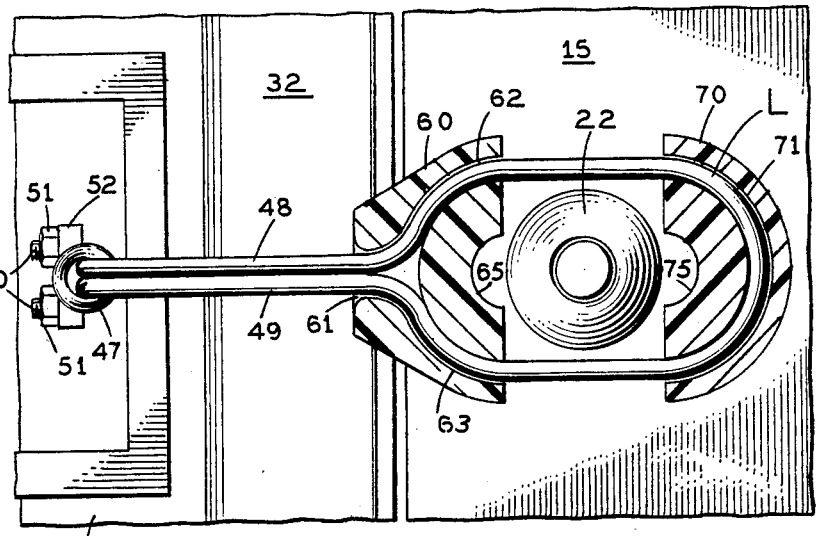
FIG. 6 is a view partly in elevation and partly in section showing this lock device in a position encircling the doorknob but disengaged from it.

In this embodiment of the invention, the cable carries an inner sleeve 60 and an outer sleeve 70, both of generally C-shaped configuration. The inner sleeve at its side away from the doorknob has a central opening 61 (FIG. 6) which snugly but slidably receives both the upper and lower legs 48 and 49 of the cable, an upper arcuate passageway 62 extending from the opening 61 toward the doorknob and snugly but slidably receiving the upper leg 48 (only) of the cable, and a lower arcuate passageway 63 leg 48 (only) of the cable, and a lower arcuate passageway 63 extending from the opening 61 toward the doorknob and snugly but slidably receiving the lower leg 49 (only) of the cable. The upper and lower passageways 62 and 63 are both open at the right side of the inner sleeve 60, i.e., the side toward the doorknob. At this side the inner sleeve presents a semicircular recess 65 for snug engagement against the adjacent inner side of the doorknob neck 23, as shown in FIG. 5. As shown in FIG. 2, at the side where the opening 61 is located the inner sleeve 60 has a protrusion 64 which projects toward the door for engagement with the inside face of the door between the cover plate 26 and the adjacent vertical edge 21 of the door.

The outer sleeve 70 has a continuous arcuate passageway 71 (FIG. 6) into which the upper and lower legs of the cable extend to form the cable loop L, which is snugly but slidably received in this passageway. At its side toward the doorknob the outer sleeve 70 presents a semi-circular recess 75 for snug engagement against the outer side of the doorknob neck 23, as shown in FIG. 5.

Figure 3:
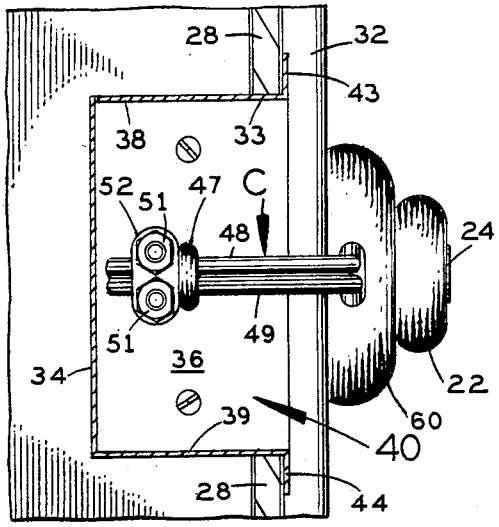
FIG. 3 is a vertical section taken along the line 3—3 in FIG. 2.
Figure 4:
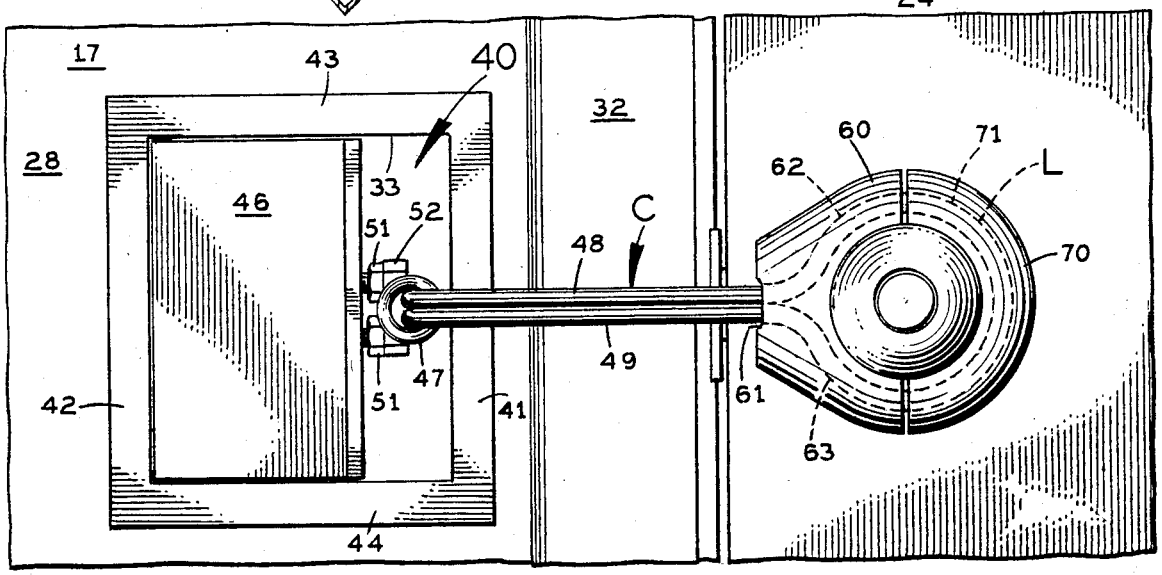
FIG. 4 is an elevational view of this lock device in place on the doorknob.

To put the cable on the doorknob, the cable is pulled out of the box 34 in the building wall 17 as far as possible, i.e., until the cable clamp 50–52 engages the eye 47. The outer sleeve 70 and the inner sleeve 60 are positioned far enough apart along the cable to permit the enlarged head 22 of the doorknob to pass between them when the loop end L of the cable is put on the doorknob, as shown somewhat exaggerated in FIG. 6. Then the inner sleeve 60 is slid along the cable toward the doorknob to shorten the cable loop L until both sleeves 60 and 70 are snugly engaged against the neck 23 of the doorknob behind its head 22, i.e., between the doorknob neck 22 and the cover plate 26 on the adjacent face of the door, as shown in FIGS. 3 and 4. In this position of the parts, the projection 64 on the inner sleeve 60 engages the door on the side of the cover plate 26 which is nearest the edge 21 of the door, and to the right of this projection this sleeve is snugly received between the cover plate 26 and the head of the doorknob. Consequently, the slight slack in the cable produced by shortening its loop L does not permit an intruder to force the door even partly open.

When the cable is not in use it can be stored in the box 34 in the wall with the cover 46 closed. The cable is removed from the doorknob by sliding the inner sleeve 60 along the cable away from the doorknob and thereby increasing the length of the loop L enough to enable it to be slipped over the doorknob head 22.

FIGS. 7–9

Corresponding elements of the second embodiment of the invention, shown in these figures, are given the same reference numerals plus 100 as those of the first embodiment, already described in detail with reference to FIGS. 1–6. The detailed description of these corresponding elements will not be repeated.

Figure 7:
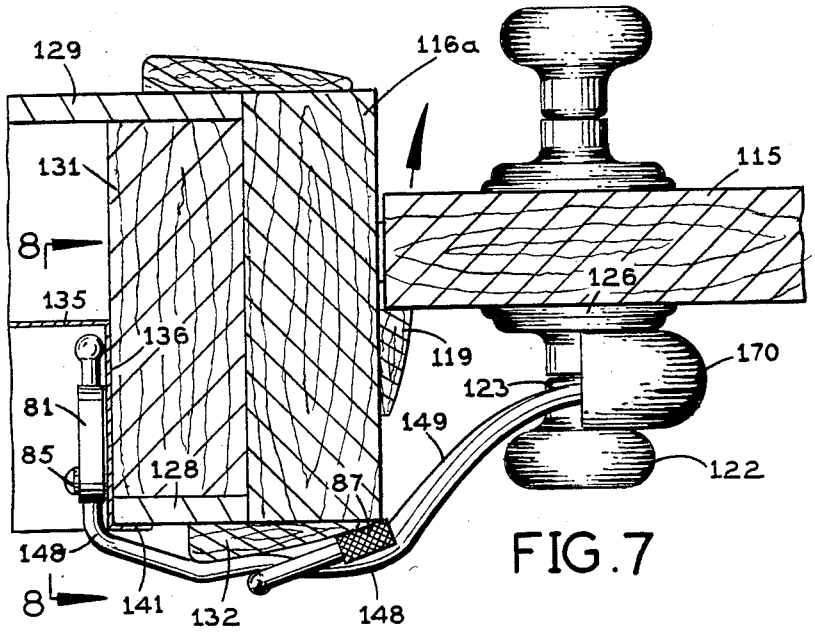
FIG. 7 is a horizontal sectional view of a second embodiment of the present lock device on a doorknob on an outward-opening door in a wood frame.

The door 115 is hinged at the right in FIG. 7 and opens out.

Figure 8:
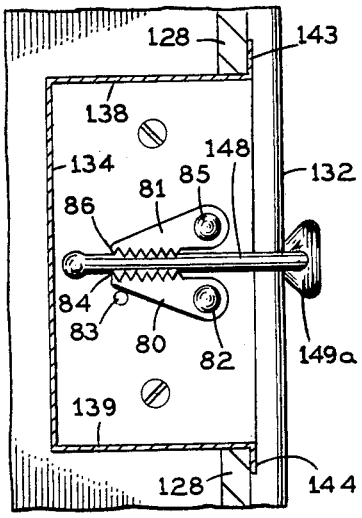
FIG. 8 is a vertical section taken along the line 8—8 in FIG. 7.

Only the upper leg 148 of the cable extends into the box 134 in the building wall. Here it is engaged by a releasable clamp having a lower jaw 80 and an upper jaw 81 (FIG. 8). The lower jaw 80 is attached near its front end to the side wall 136 of box 134 by a fastener 82. Near its back end the lower jaw 80 rests on a pin 83 extending out from this side wall of the box. The lower jaw has a series of teeth 84 along the top for biting engagement with the cable leg 148 from below. The upper jaw is pivotally mounted at 85 near its front end and has teeth 86 along the bottom for biting engagement with the cable leg 148 from above. The upper jaw 81 may be grasped manually and pivoted up from the cable-engaging position of FIG. 8 to release the cable leg 148.

The lower leg 149 of the cable is bent back upon itself at 149*a* into a relatively tight loop which is held closed by a fastener collar 87. The upper leg 148 of the cable passes slidably through this loop 149*a*.

Figure 9:
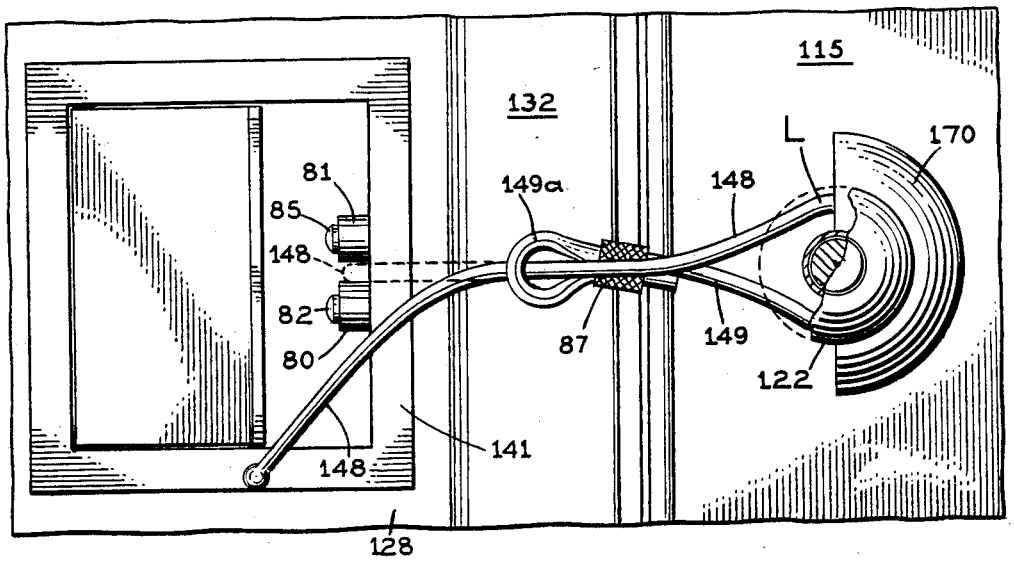
FIG. 9 is an elevational view of this second lock device in locking position on the doorknob.

To the right of the loop 149*a* in FIG. 9 the opposite legs 148 and 149 of the cable from a loop L which passes slidably through an outer sleeve 170 of generally C-shaped configuration.

In the use of this lock device, before the cable is put on the doorknob the upper jaw 81 of the cable clamp is pivoted up to release the cable leg 148 and this cable leg is pulled out of the in-the-wall box 134, as shown in full lines in FIG. 9. Now the cable can be slipped over the doorknob head 122 and onto the smaller neck portion 123 of the doorknob behind its head with the outer sleeve 170 engaged snugly between the doorknob head 122 and the cover plate 126 on the door. Then the lower leg 148 of the cable is inserted back into the box 134 in the building wall and is passed back between the clamping jaws 80 and 81 to shorten the loop L in the cable until there is little or no slack or "play" in the cable with the door closed. The clamping jaws 80 and 81 grip this end of the cable and prevent an intruder from opening the door as long as the cable remains looped over the doorknob as described, with the sleeve 70 engaged snugly between the door knob head 122 and the cover plate 126 on the door.

Figure 10:
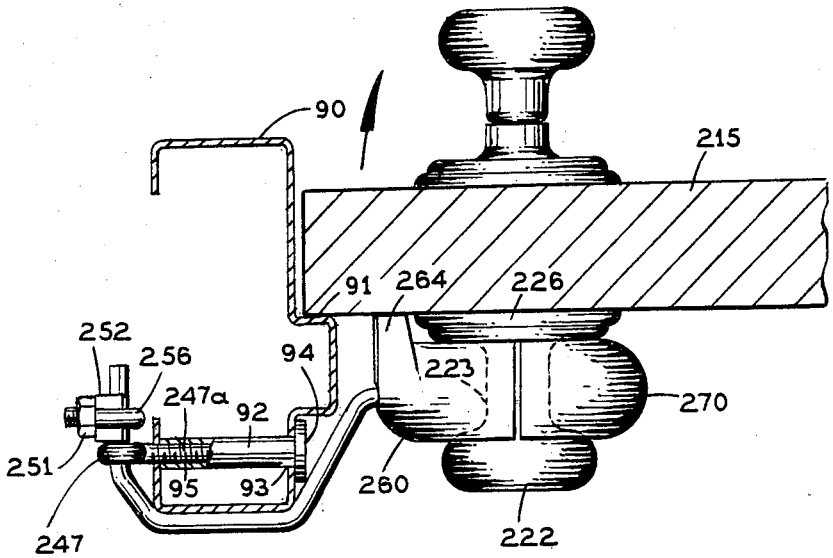
FIG. 10 is a horizontal section showing a third embodiment of the present lock device on the doorknob of a door which has a steel doorway frame and opens to the outside.
Figure 11:
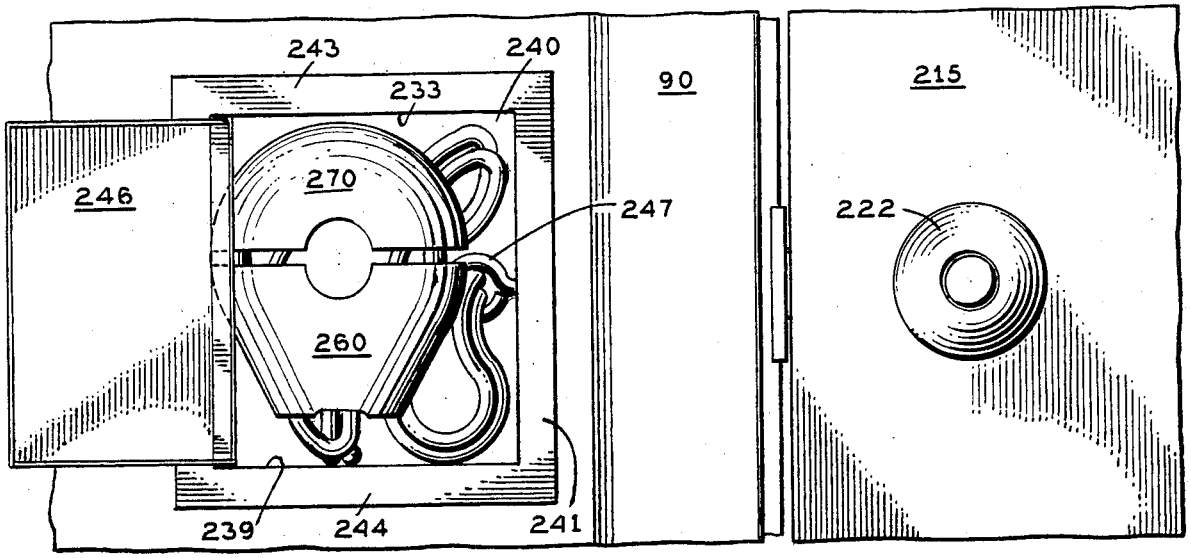
FIG. 11 is an elevational view showing this third embodiment of the present lock device in its stored position detached from the doorknob.

FIGS. 10 and 11

The third embodiment of the invention, shown in FIGS. 10 and 11, is basically similar to the first embodiment (FIGS. 1–6) except that it is shown with a door that opens out and is in a steel doorway frame. Elements of the locking device in FIGS. 10 and 11 which correspond to elements of the lock device in FIGS. 1–6 are given the same reference numerals plus 200 and will not be described again in detail.

The steel doorway frame presents a vertical door jamb 90 with a door stop 91 that is engageable by the inside face of the door 215 just to the left of the doorknob 222, 223 in FIG. 10 when the door is closed. This door is hinged along its right side.

A metal socket member 92 extends through a horizontal opening 93 in the door jamb 90 just in front of the door stop 91. An enlarged head 94 on socket member 93 limits its insertion into the door jamb. The opposite end of socket member 92 presents a screw-threaded recess 95 which threadedly receives the externally screw threaded stem or shank 247*a* of eye 247, which slidably receives the upper and lower legs of the cable as already desreceives the upper and lower legs of the cable as already described with reference to FIGS. 1–6. A clamp 250, 251, 252 engages the legs of the cable at this end to secure them to each other and to prevent their removal from the in-the-wall box 234 past the eye 247.

When not in use, the cable and sleeves 260 and 270 can be stored in the box as shown in FIG. 11.

When removed from this box, the cable and sleeves can be put in locking position on the doorknob in the same manner as described with reference to FIGS. 1–6.

In any of the foregoing embodiments, the connection of the inside doorknob to the usual rotatable shank which operates the lock can be made stronger by drilling a cross-hole through the doorknob neck (e.g., 23 in FIG. 2) and the shank and inserting a crosspin or bolt to connect them rigidly.

If desired, the cable C may be in the form of a plastic-covered chain instead of a stranded cable.

We claim:

1. A lock device for use on a door having a doorknob which extends out from the door and has a head on its outer end away from the door and a neck of smaller cross-section than the head extending from the head toward the door, said lock device comprising:

a flexible cable having elongated opposite legs and a loop joining said legs and forming one end of the cable;

means for retaining the cable at its opposite end from said loop;

a first sleeve receiving the cable at said loop and shaped and dimensioned to extend part-way around said neck of the doorknob between said head of the doorknob and the door after said loop is inserted over the head of the doorknob;

and a second sleeve on the cable between said first sleeve and said opposite end of the cable, said second sleeve having an opening slidably receiving both of said opposite legs of the cable and having two passageways connected to said opening and diverging from each other away from said opening and slidably passing individually said opposite legs of the cable, said second sleeve being slidable along the cable away from said opposite end to shorten said loop, said second sleeve being shaped and dimensioned to extend around the opposite side of the neck of the doorknob from said first sleeve.

2. A lock device according to claim 1 wherein said means for retaining the cable at its opposite end comprises:

a guide member for slidably receiving both said opposite legs of the cable near its opposite end;

means for mounting said guide member on a building wall next to said door;

and clamp means on said opposite legs of the cable at its opposite end, said clamp means being large enough to abut against said guide means and prevent said opposite end of the cable from being withdrawn through said guide means when the cable is pulled out to pass its loop and said first sleeve over the head of the doorknob.

3. A lock device according to claim 2 wherein:

said guide and said means for mounting are constituted by an eye having a loop slidably receiving said opposite legs of the cable and a screw-threaded stem for attachment to a wall stud.

4. A lock device according to claim 2 wherein:

said guide is an eye having a loop slidably receiving said opposite legs of the cable and screw-threaded stem;

and said means for mounting is a socket member having an enlarged head at one end for engagement against the outside of a hollow metal door jamb and a screw-threaded recess in its opposite end for threadedly receiving said stem of the eye inside said door jamb.

5. A lock device for use on a door having a doorknob which extends out from the door and has a head on its outer end away from the door and a neck of smaller cross-section than the head extending from the head toward the door, said lock device comprising:

a flexible cable having elongated opposite legs and a loop joining said legs and forming one end of the cable;

one of said opposite legs of the cable terminating in a loop slidably passing the other of said legs of the cable;

means for retaining the cable at its opposite end from said loop comprising a clamp mounted on a building wall next to the door and engaging said other leg of the cable, said clamp being manually releasable from said other leg of the cable;

and a sleeve receiving the cable at said loop and shaped and dimensioned to extend part-way around said neck of the doorknob between said head of the doorknob and the door after said loop is inserted over the head of the doorknob.

6. A lock device according to claim 5 wherein:

said clamp comprises opposed jaws on opposite sides of said other leg of the cable having teeth thereon for gripping engagement with said other leg of the cable, one of said jaws being pivotally displaceable manually to release said other leg of the cable.

* * * * *